US005967686A

United States Patent [19]

Melnick

[11] Patent Number: 5,967,686

[45] Date of Patent: Oct. 19, 1999

[54] MARKING INSTRUMENT WITH SOUND PRODUCING APPARATUS

[75] Inventor: Deborah L. Melnick, Ardmore, Pa.

[73] Assignee: Debbie Lynn, Inc., Ardmore, Pa.

[21] Appl. No.: 09/163,607

[22] Filed: Sep. 30, 1998

[51] Int. Cl.[6] ..... B43K 29/00

[52] U.S. Cl. ..... 401/195; 401/52; 401/243

[58] Field of Search ..... 401/195, 52, 202, 401/243, 244, 245, 246, 247

[56] References Cited

U.S. PATENT DOCUMENTS

| | | | |
|---|---|---|---|
| D. 324,238 | 2/1992 | Nitta . | |
| 4,371,278 | 2/1983 | Joo . | |
| 4,763,355 | 8/1988 | Cox . | |
| 4,812,068 | 3/1989 | Seong . | |
| 4,969,180 | 11/1990 | Watterson et al. . | |
| 4,984,494 | 1/1991 | Yang . | |
| 5,119,932 | 6/1992 | Semanoff . | |
| 5,131,775 | 7/1992 | Chen . | |
| 5,174,440 | 12/1992 | Chiu . | |
| 5,251,112 | 10/1993 | Chen . | |
| 5,313,557 | 5/1994 | Osterhout . | |
| 5,405,207 | 4/1995 | Zubli . | |
| 5,433,642 | 7/1995 | Chia . | |
| 5,544,967 | 8/1996 | Yao | 401/52 |
| 5,673,996 | 10/1997 | Ducker . | |
| 5,688,063 | 11/1997 | Yu et al. . | |
| 5,826,998 | 10/1998 | Shih | 401/52 |

OTHER PUBLICATIONS

Sound–Producing Promotional Article (appln. filed approximately 1995).

*Primary Examiner*—David J. Walczak
*Attorney, Agent, or Firm*—Sperry, Zoda & Kane

[57] ABSTRACT

Marking instrument having a cap with a sound producing apparatus mounted therein. The sound producing apparatus includes a sound generating electronic member along with a switch and an optional button for controlling the mode of operation of the switch for determining whether the sound and/or music is generated thereby. The sound producing apparatus is retained within the cap between an intermediately positioned shoulder member and a retaining ring extending into the upper opening of the cap. The retaining ring defines an orifice through which the button member or switch means of the electronic member may extend. The retaining ring is preferably formed as a single integral member with a clip for facilitating mounting thereof with respect to the marking instrument cap to facilitate retaining of the clip member extending longitudinally along the cap of the writing instrument as well as holding the retaining ring within the opening of the cap for fixedly holding the sound producing apparatus therein. In this configuration the cap preferably defines a chamber for covering the marking tip which also includes the sound producing apparatus therein with the intermediate shoulder positioned therebetween.

20 Claims, 2 Drawing Sheets

MARKING INSTRUMENT WITH SOUND PRODUCING APPARATUS

BACKGROUND OF THE INVENTION

1. Field of the Invention

The present invention deals with the field of devices for marking on substrates. Such marking devices include writing instruments such as pens, pencils and mechanical pencils as well as marking implements such as markers, felt tip markers, etc.

More particularly this invention deals with the field of such marking instruments including auxiliary operating devices and most particularly the present invention deals with devices wherein the auxiliary operating apparatus comprises a sound or music generating item. The present invention provides an improved item which is capable of being produced in a very narrow profile since many prior art devices utilized for producing such music in the writing instrument field have been very large and cumbersome. Since the present invention can be produced at approximately 14.5 millimeters in diameter for the barrel or less across the cap, a more pleasing profile can be achieved as would be expected in a writing instrument which does not include any auxiliary music generating means. Furthermore the present invention is a step in advancement of the prior art since it includes a means for initiating operation of the music as well as a means for selectively terminating such music or other sound producing apparatus.

2. Description of the Prior Art

Many prior art devices have been utilized for the purposes of attaching auxiliary equipment with respect to an auxiliary separate operating implement with respect to a writing instrument such as sound or music generating means as shown in the U.S. Pat. No. 4,371,278 patented Feb. 1, 1983 to H. Joo on a "Musical Pen"; and U.S. Pat. No. 4,763,355 patented Aug. 9, 1988 to J. Cox on a "Combined Writing And Signaling Instrument"; and U.S. Pat. No. 4,812,068 patented Mar. 14, 1989 to J. Seong on a "Writing Device With Alarm"; and U. S. Pat. No. 4,969,180 patented Nov. 6, 1990 to M. Watterson et al and assigned to I.I.N.V. Computing Ltd. on a "Cordless Pen Telephone Handset"; and U.S. Pat. No. 4,984,494 patented Jan. 15, 1991 to M. Yang on a "Tuning Pen"; and U.S. Design Pat. No. Des.324,238 patented Feb. 25, 1992 to T. Nitta and assigned to Tokai Corporation on a "Writing Instrument"; and U.S. Pat. No. 5,119,932 patented Jun. 9, 1992 to I. Semanoff and assigned to Unified Printing & Promotions Corp. on a "Musical Base For Desk Top Articles"; and U.S. Pat. No. 5,131,775 patented Jul. 21, 1992 to C. Chen on a "Retractable Pen With Illumination Means"; and U.S. Pat. No. 5,174,440 patented Dec. 29, 1992 to C. Chiu on a "Lipstick Case Equipped with A Sound Generating Unit"; and U.S. Pat. No. 5,251,112 patented Oct. 5, 1993 to M. Chen on a "Flashing And Musical Device For A Writing Implement"; and U.S. Pat. No. 5,313,557 patented May 17, 1994 to R. Osterhout and assigned to Machina on a "Pen Recorder"; and U.S. Pat. No. 5,405,207 patented Apr. 11, 1995 to L. Lubli on a "Voice Pen For Generating Audible Messages"; and U.S. Pat. No. 5,433,642 patented Jul. 18, 1995 to F. Chia on a "Toy Marking Device With Changing Display"; and U.S. Pat. No. 5,673,996 patented Oct. 7, 1997 to D. Ducker on a "Pen With Led Indicator"; and U.S. Pat. No. 5,688,063 patented Nov. 18, 1997 to K. Yu et al on a "Writing Apparatus with Massager Means".

SUMMARY OF THE INVENTION

The present invention provides a marking instrument which is particulary usable for producing sounds wherein the sound producing apparatus is mounted in the cap area thereof. This marking instrument preferably includes a housing member with a dispensing chamber being defined therein. The housing member also includes an outer surface which facilitates gripping thereof for conventional use of the instrument for marking or writing.

The marking instrument includes a dispensing member which allows the dispensing of marking media therefrom. It preferably includes a media supply chamber therein for holding the marking media to facilitate this dispensing. The dispensing member preferably also includes a tip positioned in fluid flow communication with respect to the media supply chamber for extending outwardly therefrom to facilitate marking. This tip can be a roller ball or a porous and/or fibrous nib as conventionally used with current marking and writing instrument.

A cap is included which defines a first opening and a second opening therein. This cap preferably defines a tip containment chamber therein in fluid flow communication with respect to the first opening. The first opening and the tip containment chamber are adapted to receive the housing member therein with the tip of the dispensing member extending positioned therewithin for covering thereof and preventing drying out of the tip. This covering position is responsive to the cap being detachably secured with respect to the housing member adjacent to the first opening.

The cap also will define a sound producing chamber in fluid flow communication with respect to the second opening. The cap includes an intermediate shoulder within the sound producing chamber spatially disposed from the second opening. The tip containment chamber and the sound producing chamber are preferably in fluid flow communication with respect to one another with the intermediate shoulder positioned therebetween. The sound producing chamber is preferably larger in diameter than the tip containment chamber. Also preferably the cap means is less than approximately sixteen millimeters in diameter such that the overall look of the writing instrument is similar to a standard writing instrument and, as such, the inclusion of the sound generating apparatus is not readily obvious.

The marking instrument preferably includes a sound generating apparatus mounted within the sound producing chamber of the cap adjacent the intermediate shoulder for helping retain the sound generating apparatus positioned therewithin. This sound generating apparatus is preferably operable to generate sound and/or music as desired. The sound generating apparatus includes a sound generating electronic means which generates musical or other sounds as desired responsive to being activated. The sound generating electronic means is responsive to being deactivated to cease generating such sounds. Furthermore the sound generating electronic means can include a powering means for providing electrical power such as one or more batteries. The electronic means may further include a sound producing integrated circuit device electrically connected to these batteries. Also, one or more miniature speakers may be electrically connected to the battery and the sound producing integrated circuit for generating the sound therefrom.

A switch may also be included connected electrically with respect to the sound generating electronic device. This switch is selectively operable within a first mode and a second mode. The switch is responsive to being in a first mode for selectively activating the sound generating electronic device and being responsive to being in the second mode for selectively deactivating the sound generating electronic device.

A button may be included extending outwardly away from the cap and electrically operably connected to the switch. This button is preferably responsive to being depressed with the switch means being in the first mode to change the switch to the second mode. It is also responsive to being depressed with the switch being in the second mode to change the switch to the first mode. The button extends preferably outwardly from the cap means axially and longitudinally with respect to the cap. The button preferably also includes a resilient return spring to facilitate return of the button to the position extending outwardly away from the cap and, in particular, in the steady state positioning thereof. A timing device may also be included which is adapted to initiate operation responsive to activation of the sound generating or electronic means and which is also adapted to deactivate the sound generating electronic device after a predetermined time period subsequent to activation thereof.

A retaining ring is preferably included fixedly secured with respect to the second opening for at least partially extending thereover and facilitating the retaining of the sound generating apparatus within the sound producing chamber. This retaining ring is preferably annular in shape and defines a central orifice therein through which the button extends in such a manner as to be operatively connected with respect to the switch. The retaining ring preferably includes an annular shoulder member extending therearound in abutment with the cap surrounding the second opening in order to facilitate fixed securement of the retaining ring with respect thereto for maintaining it within the second opening and further retaining the sound generating device within the sound producing chamber. A clip member is also preferably included secured to the retaining ring and extending therefrom along the cap to facilitate mounting of the marking device where desired. The clip member and the retaining ring are preferably formed together as a single integral part to facilitate strengthening thereof and prevent unwanted damage being inflicted upon the clip member during use. This single integral structure also facilitates holding of the retaining ring in position within the cap in such a manner as to aid in retaining the sound producing apparatus within the cap as desired.

It is an object of the present invention to provide a marking instrument with sound producing apparatus mounted in the cap thereof wherein the number of moving parts is minimal.

It is an object of the present invention to provide a marking instrument with sound producing apparatus mounted in the cap thereof wherein a slender overall writing instrument profile is achieved despite the inclusion of music and/or sound producing apparatus.

It is an object of the present invention to provide a marking instrument with sound producing apparatus mounted in the cap thereof wherein an overall pen diameter of sixteen millimeters or less is achievable.

It is an object of the present invention to provide a marking instrument with sound producing apparatus mounted in the cap thereof wherein strengthening of all parts is enhanced to minimize damaging to the parts of the writing instrument.

It is an object of the present invention to provide a marking instrument with sound producing apparatus mounted in the cap thereof wherein ease of manufacture is facilitated.

It is an object of the present invention to provide a marking instrument with sound producing apparatus mounted in the cap thereof wherein deactivation of the sound producing equipment is easy to achieve as is activation of the sound producing equipment.

It is an object of the present invention to provide a marking instrument with sound producing apparatus mounted in the cap thereof wherein multiple configurations for the shape and contour of the button can be achieved which is operable to control the switch for the sound producing equipment.

It is an object of the present invention to provide a marking instrument with sound producing apparatus mounted in the cap thereof wherein the large unattractive design of previous musical generating writing instruments is avoided due to the slender attractive profile achievable by the positioning of the apparatus of the present invention.

It is an object of the present invention to provide a marking instrument with sound producing apparatus mounted in the cap thereof wherein sound can be produced for various musical selections or other sounds as desired.

It is an object of the present invention to provide a marking instrument with sound producing apparatus mounted in the cap thereof wherein an overall pen design is produced which is stronger than prior art writing instruments which produce sounds.

It is an object of the present invention to provide a marking instrument with sound producing apparatus mounted in the cap thereof wherein a timing device is included for ceasing operation of the music if no second signal is received within a predetermined time period of approximately 30 to 60 seconds.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
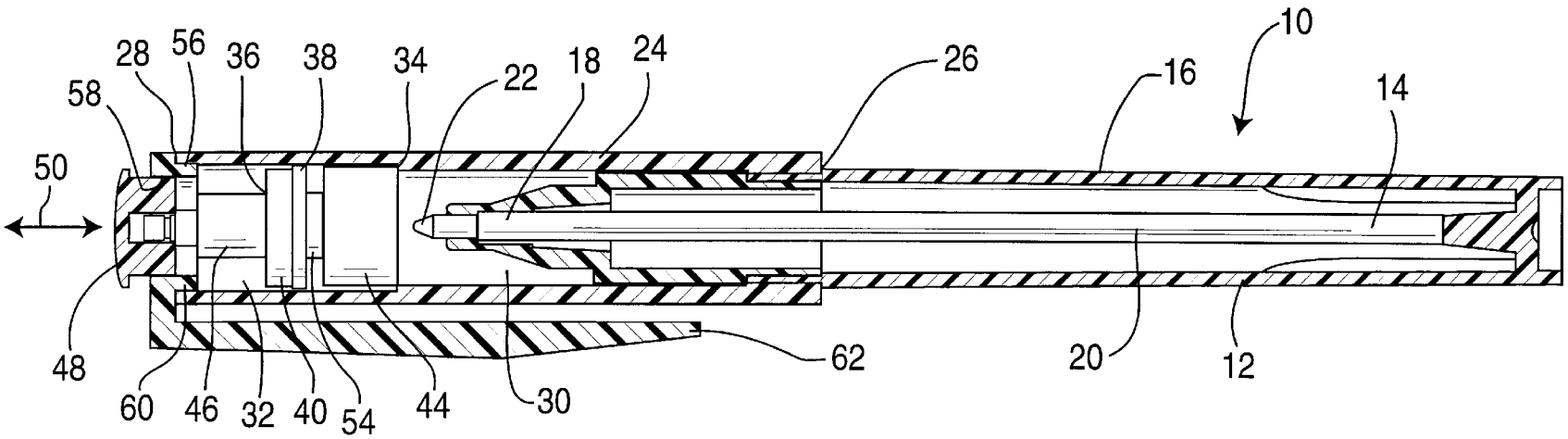
FIG. 1 is a side cross-sectional view of an embodiment of the marking instrument of the present invention.

The present invention provides a marking instrument 10 having a housing member 12 defining a dispensing chamber 14 therein. The dispensing chamber 14 preferably is adapted to receive a dispensing member 18. Dispensing member 18 is adapted to hold media within a media supply chamber means 20 defined therewithin. A tip 22 normally positioned at one end of the dispensing member 18 is adapted to dispense marking media from the chamber means 20. This tip 22 preferably can take the form of a conventional roller ball or a fibrous marking nib as with marking pens.

In the preferred configuration the housing 12 of the marking instrument 10 defines an outer surface 16 which is preferably less than or equal to approximately fifteen millimeters.

A cap 24 is included which is designed to extend over and cover the tip 22 to prevent it from drying out. The cap preferably is also of streamline design being less than or equal to approximately sixteen or seventeen millimeters. In the preferred configuration the cap 24 defines a first opening 26 therein which is adapted to receive the tip 22 of the dispensing member 18 extending therein. The first opening 26 is preferably directly in fluid flow communication with respect to a tip containment chamber 30 defined within the cap 24 for preventing drying of the tip 22 when held therewithin.

Cap 24 preferably also defines a second opening means 28 preferably positioned in the opposite end thereof from the first opening. This second opening 28 is preferably in fluid flow communication with respect to a sound producing chamber 32 defined within the cap 24. The interior dimension of the sound producing chamber is preferably smaller than the interior dimension of the tip containment chamber 30 in such a manner as to define an intermediate shoulder 34 positioned therebetween.

This intermediate shoulder 34 is of particular importance in helping in the retaining of a sound generating apparatus 36 within the sound producing chamber 32.

The sound generating apparatus 36 preferably includes a sound generating electronic means such as an integrated circuit or the like 38 which can be activated or deactivated to cause the generation of sounds therefrom. These sounds can comprise any type of audible output but most preferably would include electronic music. A power supply for powering of the sound generating electronic device 38 is included with a battery or powering device 40. This device when connected to the sound generating electronic means 38 such as a sound producing electronic integrated circuit 42 will be able to generate audible music through a miniature speaker 44 which is preferably included within the sound generating apparatus 36.

Control of operation of the sound generating apparatus of the present invention is achievable through a switch 46 which is positionable within a first mode for allowing music to be generated by the sound generating apparatus 36 and a second mode which turns off the sound generating electronics 38.

Operation of the switch 46 between the first mode and the second mode is achievable preferably by a button 48. This button 48 is preferably oriented to be movable axially outwardly as shown by arrow 50 to achieve control in operation of the switch 46.

The button means 48 will preferably include a resilient return member such as a spring 52 for maintaining the button in the outwardmost position when it is not being depressed.

A retaining ring 56 is adapted to be positioned within the second opening 28 of the cap 24 in such a manner as to provide an upper retaining member for holding the sound generating apparatus 36 within the sound producing chamber 32 of cap 24. This retaining ring 56 can extend slightly through the second opening 28 and into the sound producing chamber 32 in such a manner as to retain the sound generating apparatus 36 between the retaining ring 56 and the intermediate shoulder 34.

In a preferred configuration the retaining ring 56 will define a central orifice 58 therein which will allow the retaining ring 56 to take the form of an annular member. The central orifice 58 is adapted to receive the button means 48 preferably extending therethrough such that it is movable axially in a longitudinal orientation as shown by arrow 50. Retaining ring 56 also can include an annular shoulder 60 which protrudes slightly into and through the second opening 28 into the sound producing chamber 32. This annular shoulder member 60 will maintain firm engagement between the annular aspect of the retaining ring 56 and the second opening 28 of the cap 24 in such a manner as to facilitate holding of the sound generating apparatus 36 within the sound producing chamber 32.

A clip member 62 will be included fixedly secured to the cap 24. In the preferred configuration clip member 62 will be integrally formed as a single part with respect to the retaining ring 56 and the annular shoulder member 60 thereof. With the formation of the retaining ring 56 and the clip member 62 as a single integral member a significant amount of additional strength is provided to the clip member itself. Such clip members are often subjected to extensive abusive usage and the formation of an oversize clip member by including the retaining ring 56 as an integral part thereof has been found to be a means for significantly strengthening the clip member 62. At the same time this single integral configuration will also strengthen the retaining ring 56 and the central orifice 58 extending therethrough through which the button 48 preferably extends. This retaining ring 56 has the dual found purpose of defining the central orifice 58 for receiving of the button 48 extending therethrough while at the same time strengthening the clip member and having the further additional purpose of retaining the sound generating apparatus 36 within the sound producing chamber 32.

One of the important aspects of the present invention is in the ability to form the cap 24 and the housing member 12 having narrow profiles. Preferably the cap will be no more than sixteen or seventeen millimeters in diameter and the marking instrument itself will be preferably fifteen or less millimeters in diameter. This streamline profile provides an overall aesthetic appearance which does make the inclusion of the sound producing apparatus in that specific configuration obvious. This is an important characteristic achievable by the configuration of the sound generating apparatus and the button for actuating thereof and by the formation of the clip and the retaining ring 56 as a single integral part.

Figure 2:
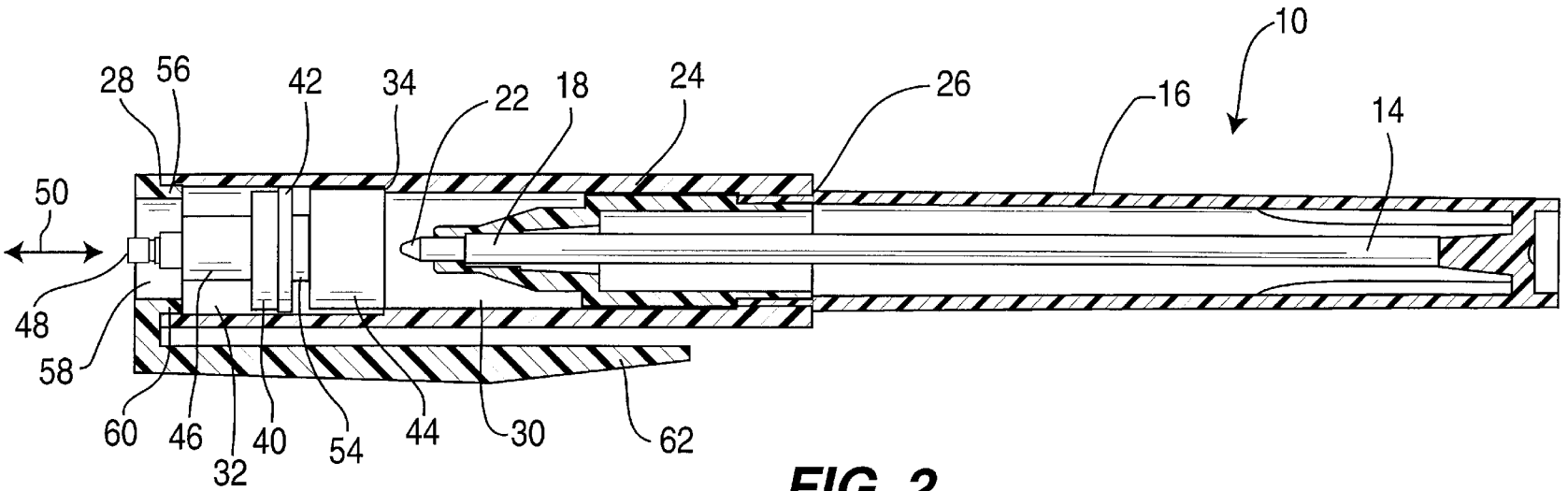
FIG. 2 is a side cross-sectional view of an alternative embodiment of the marking instrument of the present invention showing an alternate button design.
Figure 4:
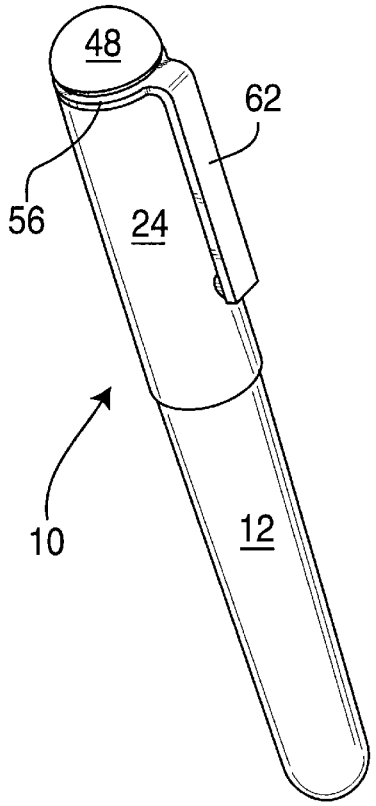
FIG. 4 is a perspective illustration of the embodiment shown in FIG. 3.
Figure 3:
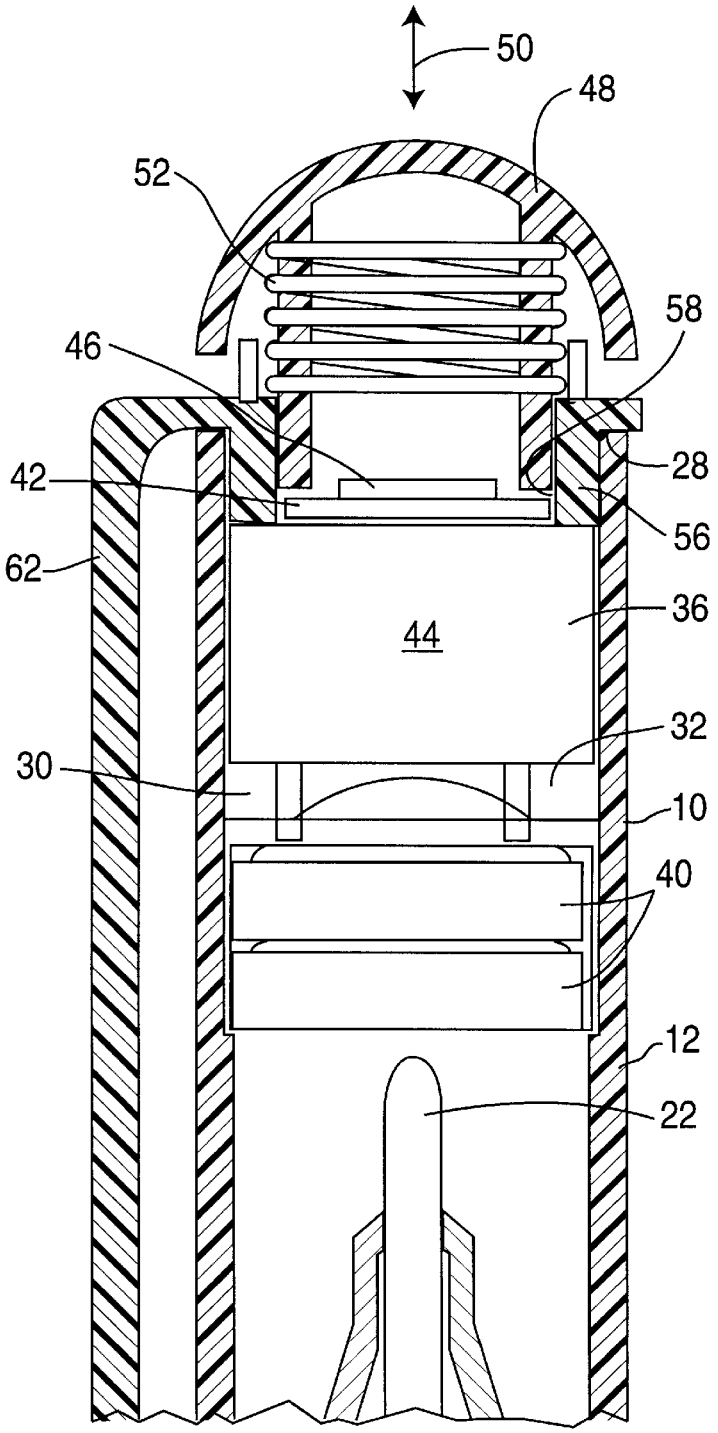
FIG. 3 is a side cross-sectional view of a portion of a further alternative embodiment of the marking instrument of the present invention showing a hemispherical outer profile activating button.

It should be appreciated that the configuration of the button of the apparatus of the present invention is shown differently in FIGS. 1, 2 and 3. FIG. 1 shows the inclusion of a curved but generally flat button whereas FIG. 2 shows a much smaller button with a flat head and FIG. 3 shows a hemispherical button and clearly there shows the resilient return spring 52 to cause movement of the button to return to the steady state position.

The apparatus of the present invention also can include a timing means 54. Such timing means is designed to be initiated responsive to actuation of the sound producing member. Timing means 54 is operable to cease operation of the sound producing member and make it go silent after operation for a predetermined time period which can be chosen normally between 30 and 60 seconds. This allows the device to be turned off when accidentally initiated by a user.

Another important aspect of the present invention is in the ability to not only start operation or sound generation by control of the switch 46 and the button 48 but also to be capable of ceasing the generation of sound by operation of the same button and/or switch. There are two basic modes of capability of this operation. In the configurations shown in FIGS. 2 and 3 depressing of the button 48 will cause activation of the sound generating electronic means 38. Subsequent thereto while sound is being generated a second depressing of the button 48 cause sound generating electronic means 38 to cease operation and thereby go silent. On the other hand in the configuration shown in FIG. 1, the depressing of the button 48 will cause the initiation of operation of the sound generating electronic means 38 only while the button is held in the depressed position. Once the button is released the sound generating apparatus 36 will cease to operate. This alternate mode of operation is achieved by the configuration of the switch means 48 as well as by the configuration of the sound generating electronic means 38 and, in particular in the preferred embodiment, the sound producing integrated circuit 42.

The ability to start and stop the sound generating aspect of the present invention is an important design since these writing instruments are often used in business meetings or school classes or other times when silence is important. Accidental operation or operation for a very limited time is possible by control of movement of the button of the present invention since solely the operation of that button can be used to initiate as well as to cease operation of the sound generating means.

The writing or marking tip 22 of the present invention can be of any conventional design. A conventional roller ball design is one possible configuration for the tip as well as a fibrous configuration which forms a nib more commonly used with marking instruments.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A marking instrument with a sound producing apparatus mounted within the cap thereof comprising:

A. a housing member defining a dispensing chamber therewithin, said housing member including an outer surface for facilitating gripping thereof during use of the instrument for marking;

B. a dispensing member for facilitating dispensing of marking media, said dispensing member defining a media supply chamber means therewithin for holding marking media for dispensing therefrom, said dispensing member also including a tip means positioned in fluid flow communication with respect to said media supply chamber means and extending outwardly therefrom to facilitate marking therewith;

C. a cap means defining a first opening means and a second opening means therewithin, said cap means further defining a tip containment chamber means therewithin in fluid flow communication with respect to said first opening means, said first opening means and said tip containment chamber means being adapted to receive said housing member therein with said tip means of said dispensing member extending positioned therewithin for covering thereof responsive to said cap means being detachably secured with respect to said housing member adjacent said first opening means, said cap means further defining a sound producing chamber means in fluid flow communication with respect to said second opening means;

D. a sound generating apparatus mounted within said sound producing chamber means of said cap means and being operable to selectively generate sound as desired, said sound generating apparatus comprising:

(1) a sound generating electronic means adapted to generate sound responsive to being activated and responsive to being deactivated to cease generating sound;

(2) a switch means connected electrically with respect to said sound generating electronic means, said switch means being selectively operable within a first mode and a second mode, said switch means being responsive to being in a first mode for selectively activating said sound generating electronic means and being responsive to being in a second mode for selectively deactivating said sound generating electronic means; and (3) a switch actuation means electrically operably connected to said switch means and being responsive to being actuated with said switch means being in said first mode to change said switch means to said second mode and being responsive to being actuated with said switch means being in said second mode to change said switch means to said first mode.

2. A marking instrument with a sound producing apparatus mounted within the cap thereof as defined in claim 1 wherein said switch actuation means comprises a button means extending outwardly away from said cap means, said button means being electrically connected to said switch means and being responsive to being depressed with said switch means being in said first mode to change said switch means to said second mode and being responsive to being depressed with said switch means being in said second mode to change said switch means to said first mode.

3. A marking instrument with a sound producing apparatus mounted within the cap thereof as defined in claim 2 further including a retaining ring means fixedly secured within said second opening means for at least partially extending thereover and facilitating retaining of said sound generating apparatus within said sound producing chamber means.

4. A marking instrument with a sound producing apparatus mounted within the cap thereof as defined in claim 3 wherein said retaining ring is annular in shape to define a central orifice means therein through which said button means extends to be operatively connected to said switch means.

5. A marking instrument with a sound producing apparatus mounted within the cap thereof as defined in claim 4 further comprising a clip member secured to said retaining ring means and extending therefrom along said cap means to facilitating mounting of the marking instrument where desired.

6. A marking instrument with a sound producing apparatus mounted within the cap thereof as defined in claim 5 wherein said clip member is integral with respect to said retaining ring means.

7. A marking instrument with a sound producing apparatus mounted within the cap thereof as defined in claim 6 wherein said cap means includes an intermediate shoulder means within said sound producing chamber means to facilitate retaining of said sound generating apparatus therein in a position between said retaining ring means and said intermediate shoulder means.

8. A marking instrument with a sound producing apparatus mounted within the cap thereof as defined in claim 7 wherein said tip containment chamber means and said sound producing chamber means are in fluid flow communication with respect to one another with said intermediate shoulder means positioned therebetween.

9. A marking instrument with a sound producing apparatus mounted within the cap thereof as defined in claim 8 wherein said sound producing chamber means is larger in diameter than said tip containment chamber means.

10. A marking instrument with a sound producing apparatus mounted within the cap thereof as defined in claim 3 wherein said retaining ring means secured extending into said second opening means includes an annular shoulder member extending therearound in abutment with said cap means surrounding said second opening means to facilitate fixed securement of said retaining ring means with respect thereto for maintaining said retaining ring means within said second opening means and further retaining said sound generating means within said sound producing chamber means.

11. A marking instrument with a sound producing apparatus mounted within the cap thereof as defined in claim 2 wherein said button means extends axially outwardly from said cap means and moves axially longitudinally with respect thereto responsive to being depressed to control the mode of operation of said switch means.

12. A marking instrument with a sound producing apparatus mounted within the cap thereof as defined in claim 2 wherein said switch means is in a steady state electrically open position corresponding to said second mode for selectively deactivating said sound generating electronic means.

13. A marking instrument with a sound producing apparatus mounted within the cap thereof as defined in claim 12 wherein said switch means is responsive to depressing of said button means to move to said first mode for selectively activating said sound generating electronic means and is responsive to release of said button means to move back to said second mode for selectively deactivating said sound generating electronic means.

14. A marking instrument with a sound producing apparatus mounted within the cap thereof as defined in claim 1 wherein said sound generating electronic means includes:

A. a powering means to provide electrical power;

B. an sound producing integrated circuit means electrically connected to said powering means; and C. a miniature speaker means electrically connected to said powering means and said sound producing integrated circuit means for generating sound therefrom.

15. A marking instrument with a sound producing apparatus mounted within the cap thereof as defined in claim 1 wherein said sound generating apparatus further includes a timing means adapted to initiate operation responsive to activation of said sound generating electronic means and being adapted to deactivate said sound generating electronic means after a predetermined time period subsequent to activation thereof.

16. A marking instrument with a sound producing apparatus mounted within the cap thereof as defined in claim 1 wherein said cap means is less than approximately sixteen millimeters in total lateral diameter.

17. A marking instrument with a sound producing apparatus mounted within the cap thereof as defined in claim 1 wherein said sound generating electronic means comprises a music generating means for emitting music responsive to activation thereof.

18. A marking instrument with a sound producing apparatus mounted within the cap thereof as defined in claim 1 wherein said button means includes a resilient return means to facilitate return of said button means to the position extending outwardly away from said cap means in the steady state positioning thereof.

19. A marking instrument with a sound producing apparatus mounted within the cap thereof comprising:

A. a housing member defining a dispensing chamber therewithin, said housing member including an outer surface for facilitating gripping thereof during use of the instrument for marking;

B. a dispensing member for facilitating dispensing of marking media, said dispensing member defining a media supply chamber means therewithin for holding marking media for dispensing therefrom, said dispensing member also including a tip means positioned in fluid flow communication with respect to said media supply chamber means and extending outwardly therefrom to facilitate marking therewith;

C. a cap means defining a first opening means and a second opening means therewithin, said cap means further defining a tip containment chamber means therewithin in fluid flow communication with respect to said first opening means, said first opening means and said tip containment chamber means being adapted to receive said housing member therein with said tip means of said dispensing member extending positioned therewithin for covering thereof responsive to said cap means being detachably secured with respect to said housing member adjacent said first opening means, said cap means further defining a sound producing chamber means in fluid flow communication with respect to said second opening means;

D. a sound generating apparatus mounted within said sound producing chamber means of said cap means and being operable to selectively generate sound as desired, said sound generating apparatus comprising:

(1) a sound generating electronic means adapted to generate musical sounds responsive to being activated and responsive to being deactivated to cease generating musical sounds;

(2) a switch means connected electrically with respect to said sound generating electronic means, said switch means being selectively operable within a first mode and a second mode, said switch means being responsive to being in a first mode for selectively activating said sound generating electronic means and being responsive to being in a second mode for selectively deactivating said sound generating electronic means;

(3) a button means extending outwardly away from said cap means and electrically operably connected to said switch means, said button means being responsive to being depressed with said switch means being in said first mode to change said switch means to said second mode and being responsive to being depressed with said switch means being in said second mode to change said switch means to said first mode;

(4) a timing means adapted to initiate operation responsive to activation of said sound generating electronic means and being adapted to deactivate said sound generating electronic means after a predetermined time period subsequent to activation thereof;

E. a retaining ring means fixedly secured within said second opening means for at least partially extending thereover and facilitating retaining of said sound generating apparatus within said sound producing chamber means, said retaining ring being annular in shape to define a central orifice means therein through which said button means extends to be operatively connected to said switch means, said retaining ring means including an annular shoulder member extending therearound in abutment with said cap means surrounding said second opening means to facilitate fixed securement of said retaining ring means with respect thereto for maintaining said retaining ring means within said second opening means and further retaining said sound generating means within said sound producing chamber means; and F. a clip member secured to said retaining ring means and extending therefrom along said cap means to facilitating mounting of the marking instrument where desired, said clip member and said retaining ring means being formed together as a single integral part.

20. A marking instrument with a sound producing apparatus mounted within the cap thereof comprising:

A. a housing member defining a dispensing chamber therewithin, said housing member including an outer surface for facilitating gripping thereof during use of the instrument for marking;

B. a dispensing member for facilitating dispensing of marking media, said dispensing member defining a media supply chamber means therewithin for holding marking media for dispensing therefrom, said dispensing member also including a tip means positioned in fluid flow communication with respect to said media supply chamber means and extending outwardly therefrom to facilitate marking therewith;

C. a cap means defining a first opening means and a second opening means therewithin, said cap means further defining a tip containment chamber means therewithin in fluid flow communication with respect to said first opening means, said first opening means and said tip containment chamber means being adapted to receive said housing member therein with said tip means of said dispensing member extending positioned therewithin for covering thereof responsive to said cap means being detachably secured with respect to said housing member adjacent said first opening means, said cap means further defining a sound producing chamber means in fluid flow communication with respect to said second opening means, said cap means including an intermediate shoulder means within said sound producing chamber means spatially disposed from said second opening means thereof, said tip containment chamber means and said sound producing chamber means being in fluid flow communication with respect to one another with said intermediate shoulder means positioned therebetween, said sound producing chamber means being larger in diameter than said tip containment chamber means, said cap means being less than approximately sixteen millimeters in diameter;

D. a sound generating apparatus mounted within said sound producing chamber means of said cap means adjacent said intermediate shoulder means therein to facilitate retaining of said sound generating apparatus therein, said sound generating apparatus being operable to selectively generate sound as desired, said sound generating apparatus comprising:

(1) a sound generating electronic means adapted to generate musical sounds responsive to being activated and responsive to being deactivated to cease generating musical sounds, said sound generating electronic means including:

(a) a powering means to provide electrical power;

(b) an sound producing integrated circuit means electrically connected to said powering means; and (c) a miniature speaker means electrically connected to said powering means and said sound producing integrated circuit means for generating sound therefrom;

(2) a switch means connected electrically with respect to said sound generating electronic means, said switch means being selectively operable within a first mode and a second mode, said switch means being responsive to being in a first mode for selectively activating said sound generating electronic means and being responsive to being in a second mode for selectively deactivating said sound generating electronic means;

(3) a button means extending outwardly away from said cap means and electrically operably connected to said switch means, said button means being responsive to being depressed with said switch means being in said first mode to change said switch means to said second mode and being responsive to being depressed with said switch means being in said second mode to change said switch means to said first mode, said button means extending axially outwardly from said cap means and adapted to move axially longitudinally with respect thereto responsive to being depressed to control the mode of operation of said switch means, said button means including a resilient return means to facilitate return of said button means to the position extending outwardly away from said cap means in the steady state positioning thereof;

(4) a timing means adapted to initiate operation responsive to activation of said sound generating electronic means and being adapted to deactivate said sound generating electronic means after a predetermined time period subsequent to activation thereof;

E. a retaining ring means fixedly secured within said second opening means for at least partially extending thereover and facilitating retaining of said sound generating apparatus within said sound producing chamber means, said retaining ring being annular in shape to define a central orifice means therein through which said button means extends to be operatively connected to said switch means, said retaining ring means including an annular shoulder member extending therearound in abutment with said cap means surrounding said second opening means to facilitate fixed securement of said retaining ring means with respect thereto for maintaining said retaining ring means within said second opening means and further retaining said sound generating means within said sound producing chamber means; and F. a clip member secured to said retaining ring means and extending therefrom along said cap means to facilitating mounting of the marking instrument where desired, said clip member and said retaining ring means being formed together as a single integral part.

* * * * *